US006810627B2

(12) United States Patent
Reeves

(10) Patent No.: US 6,810,627 B2
(45) Date of Patent: Nov. 2, 2004

(54) MULTI-PITCH IMPROVED RIDGE-SEAL FOR TILED ROOFS

(75) Inventor: Jason Reeves, Santa Clara, CA (US)

(73) Assignee: So-Lite Corporation, San Jose, CA (US)

( * ) Notice: Subject to any disclaimer, the term of this patent is extended or adjusted under 35 U.S.C. 154(b) by 88 days.

(21) Appl. No.: 10/266,736

(22) Filed: Oct. 7, 2002

(65) Prior Publication Data

US 2003/0029098 A1 Feb. 13, 2003

Related U.S. Application Data

(63) Continuation-in-part of application No. 09/304,508, filed on May 3, 1999, now Pat. No. 6,598,353.

(51) Int. Cl.[7] ..... F24F 7/02; F24F 13/08

(52) U.S. Cl. ..... 52/57; 52/105; 52/199; 52/302.3; 454/365

(58) Field of Search ..... 52/57, 198, 199, 52/302.3, 302.6, 717.05, 798.1, 741.4, DIG. 15; 277/628, 906; 454/364–367

(56) References Cited

U.S. PATENT DOCUMENTS

| | | | | |
|---|---|---|---|---|
| 4,558,637 A | * | 12/1985 | Mason | 454/365 |
| 4,788,801 A | * | 12/1988 | Jones | 52/57 |
| 6,015,343 A | * | 1/2000 | Castillo et al. | 454/365 |
| 6,243,995 B1 | * | 6/2001 | Reeves et al. | 52/94 |
| 6,286,273 B1 | * | 9/2001 | Villela et al. | 52/199 |
| 6,598,353 B1 | * | 7/2003 | Reeves | 52/57 |
| 2003/0140582 A1 | * | 7/2003 | Sells | 52/198 |

FOREIGN PATENT DOCUMENTS

| | | | | |
|---|---|---|---|---|
| DE | 35 11 798 A1 | * | 3/1985 | E04D/1/30 |
| DE | 36 03 606 C1 | * | 2/1986 | E04D/1/36 |
| DE | 36 15 015 C1 | * | 12/1987 | E04D/1/36 |
| DE | 29819378 U | * | 2/1999 | E04D/1/36 |
| WO | 00/66855 | * | 11/2000 | E04D/13/17 |

* cited by examiner

*Primary Examiner*—Robert Canfield
(74) *Attorney, Agent, or Firm*—Donald R. Boys; Central Coast Patent Agency, Inc.

(57) ABSTRACT

A ridge seal molding having a length and width has a nailing flange with one straight edge to engage a ridge beam, the nailing potion for nailing the molding to the ridge beam, providing thereby a continuous contact along at least the one straight edge the length of the molding to the ridge beam, and a cover section formed generally at an angle to and contiguous with the nailing portion and having an undulating shape of adjacent cap and pan portions in the direction of the length to match the undulating shape of adjacent tiles along a front edge, the cover section having a sealing edge of an undulating shape opposite the one straight edge of the nailing potion. The molding is characterized in that a first dimension from a point on the one straight edge of the nailing flange to the sealing edge taken along an axis of a pan portion is substantially greater than a second dimension from a point on the one straight edge of the nailing flange to the sealing edge taken along an axis of a sealing portion, the pan portions of an installed ridge seal therefore extending further down a roof than the cap portions.

7 Claims, 9 Drawing Sheets

MULTI-PITCH IMPROVED RIDGE-SEAL FOR TILED ROOFS

CROSS-REFERENCE TO RELATED DOCUMENTS

The present application is a continuation-in-part (CIP) of application, Ser. No. 09/304,508, filed May 3, 1999, now U.S. Pat. No. 6,598,353, the specification and drawings of the prior application is incorporated herein in it's entirety by reference.

FIELD OF THE INVENTION

The present invention is in the field of roofing construction and pertains particularly to methods and apparatus for sealing ridge terminations on a tiled roof from effects of weather and exposure.

BACKGROUND OF THE INVENTION

In the field of roofing construction, one of the most popular and sought-after coverings is tile. A tile roof is a roofing system comprising a plurality of individual tiles made of fired clay, or, more recently a composite material. Tiles for such roofing construction are shaped and arranged on a roof to lie in overlapping fashion so as to completely cover a roof in a manner that rainwater will drain from one tile to another off the roof area.

Because tiles are rigid, three-dimensional shapes, intimate fit between one tile and another in an overlapping arrangement is less than perfect. For the same reason, sealing and protecting interfaces between one surface area on a roof and another, such as ridges and valleys, is often a problem. Sealing and finishing ridges is of particular importance, and is the subject of the present patent application. The ridges are the locations on a roof where opposite pitches of the roof meet at the top. Typically, a ridge-board or ridge-nailer, as it is sometimes termed, is installed along the length of a ridge and separates uppermost rows of tiles on either side after the tiles are installed. The ridge nailer projects above the height of tile on each side of the ridge, and is used in many instances for adding a ridge seal before cap tiles are placed on the ridge.

A persistent problem with developing and manufacturing ridge seals, which are typically relatively thin plastic moldings, is that roof pitches vary widely, and it is often necessary to make several different models of ridge seals to accommodate the range of pitches that may be encountered. Another problem is that it is desirable that the lower edges of ridge seals conform to the shape of adjacent tiles and firmly and intimately contact the tiles below the ridge line, to effectively bar wind and water from entering the ridge area under the cap tiles.

Still another problem proceeds from the fact that the cap tiles lie on the adjacent, repeating peaks across adjacent tiles, leaving very apparent openings under the cap tiles. A practice much used before the advent of plastic molded ridge seals has been to fill these openings with concrete. This practice is termed mudding-in in the art. The appearance of mudding in is typically desirable to homeowners, but is not efficient, is time-consuming, and is also less than durable. Over time the concrete used chips away, and may slide down the tiles creating a debris problem, may clog drains, and may even pose a safety hazard.

What is clearly needed is a method and apparatus for ridge sealing a tiled roof that is more universally applicable to varying pitches, more easily applied, more resistant to UV exposure, stronger, and more effective in sealing the ridges. Such a system would cut roofing costs by eliminating otherwise required labor, and increase longevity of a one-time tile installation without adding to maintenance time and cost.

SUMMARY OF THE INVENTION

In a preferred embodiment of the present invention a ridge seal molding having a length and width is provided, comprising a nailing flange with one straight edge to engage a ridge beam, the nailing potion for nailing the molding to the ridge beam, providing thereby a continuous contact along at least the one straight edge the length of the molding to the ridge beam, and a cover section formed generally at an angle to and contiguous with the nailing portion and having an undulating shape of adjacent cap and pan portions in the direction of the length to match the undulating shape of adjacent tiles along a front edge, the cover section having a sealing edge of an undulating shape opposite the one straight edge of the nailing potion. The molding is characterized in that a first dimension from a point on the one straight edge of the nailing flange to the sealing edge taken along an axis of a pan portion is substantially greater than a second dimension from a point on the one straight edge of the nailing flange to the sealing edge taken along an axis of a sealing portion, the pan portions of an installed ridge seal therefore extending further down a roof than the cap portions.

In preferred embodiments there is an offset lip along the sealing edge for contacting tiles in both the pan and the cap portions, and in some embodiments the lip may be arched to retain a sealant. In some preferred embodiments the cover section along an axis of a pan portion comprises a stepped panel beginning at a juncture with the nailing panel and extending to the sealing edge, the stepped panel in an installed seal being therefore substantially above the tile at the juncture with the nailing flange and in contact with the tile at the sealing edge.

In some embodiments of the ridge seal there are one or more reinforcing grooves in the direction of the length, extending over only the cap portions of the molding. Also in some embodiments there is a ridge lip along the one straight edge of the nailing panel, at an angle to the nailing panel, for engaging a top surface of the ridge beam. In some preferred embodiments material for the ridge seal molding is a material formulated for resistance to ultraviolet deterioration.

In embodiments of the invention described in enabling detail below, for the first time a ridge seal molding is provided with extended pan portions, providing thereby increased weathering endurance for a roof equipped with the ridge seal moldings of the present invention.

BRIEF DESCRIPTION OF THE DRAWING FIGURES

Figure 3:
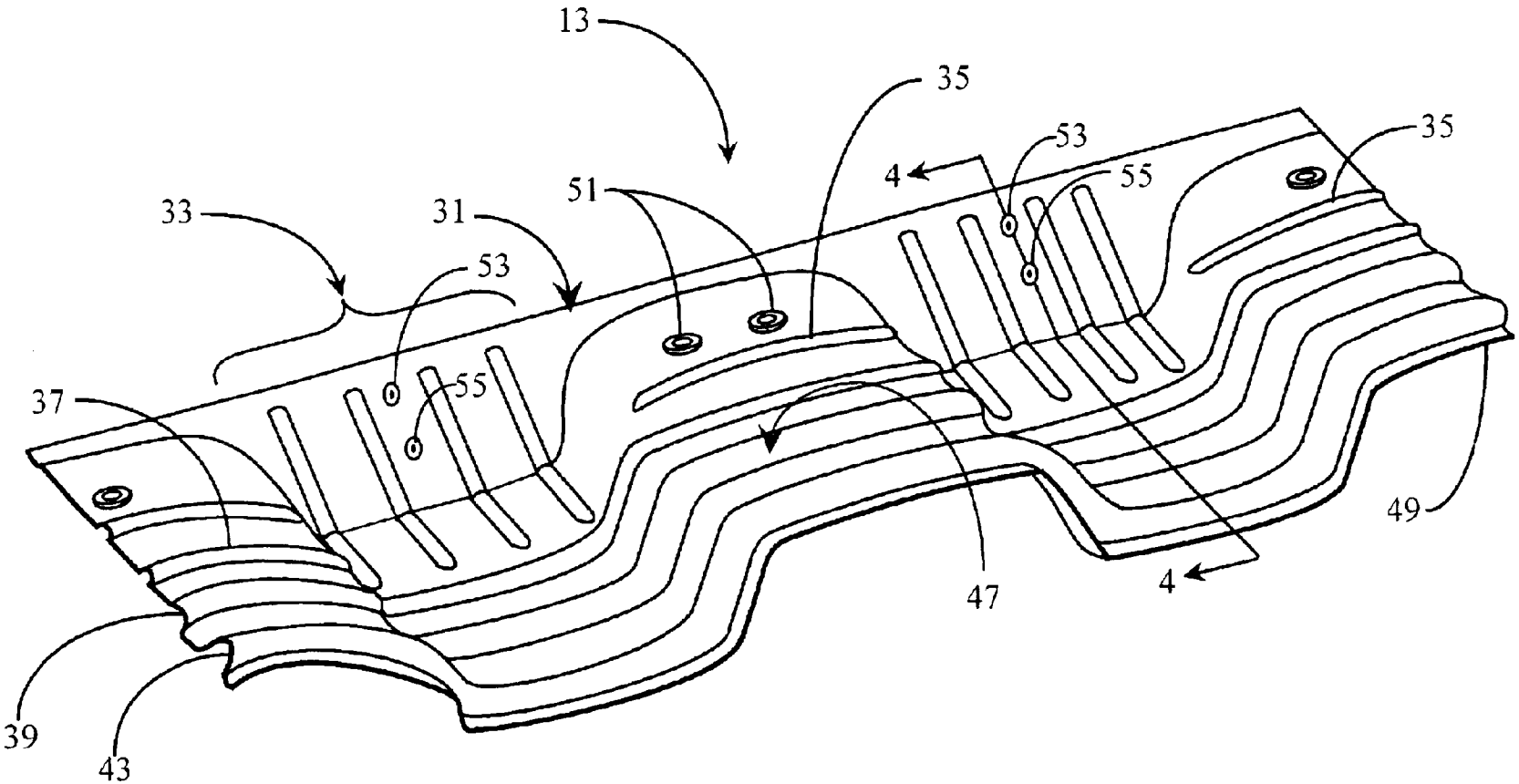
FIG. 3 is a perspective view of the ridge seals of FIG. 1 according to an embodiment of the present invention.
Figure 8A:
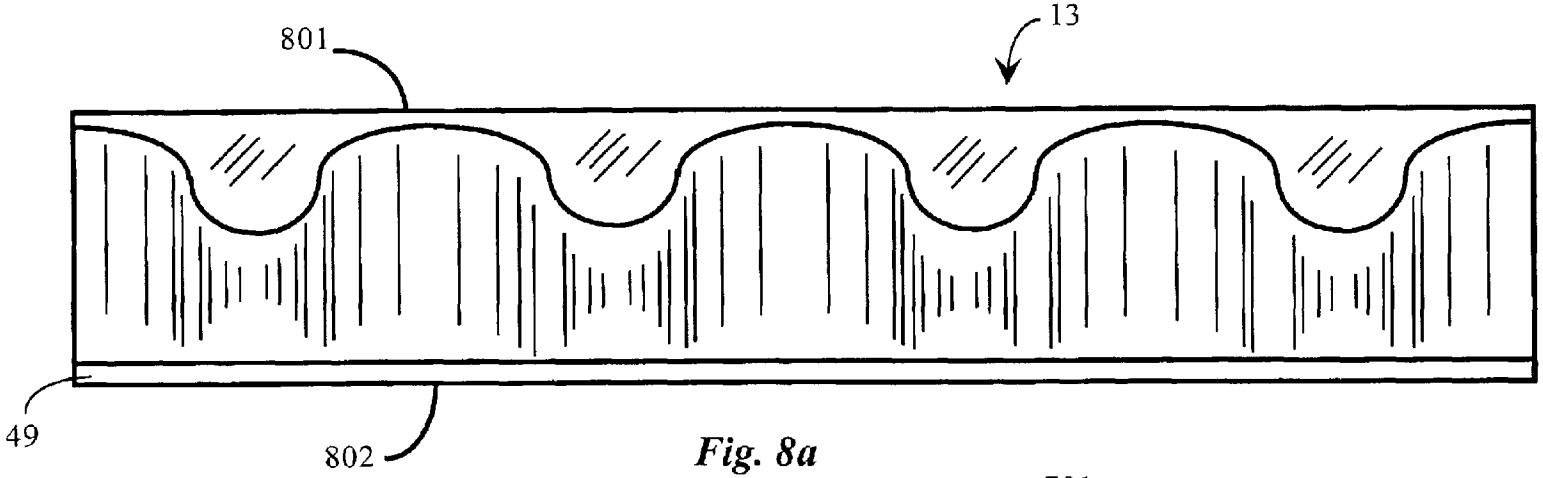

FIG. 8*a* is a plan view of an exemplary ridge seal according to the profile of FIG. 3.

Figure 7:
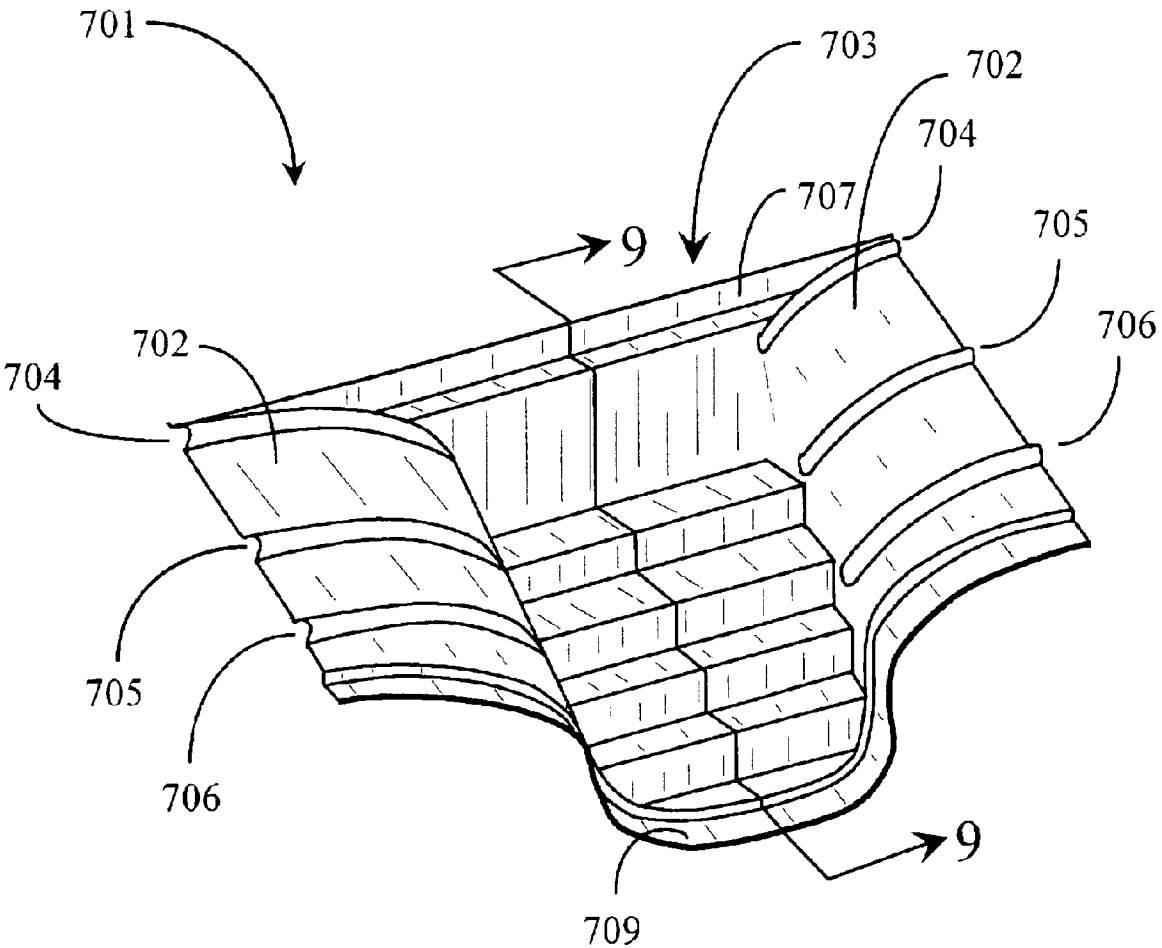
FIG. 7 is a perspective view of a portion of a ridge seal according to an alternative embodiment of the present invention.
Figure 8B:
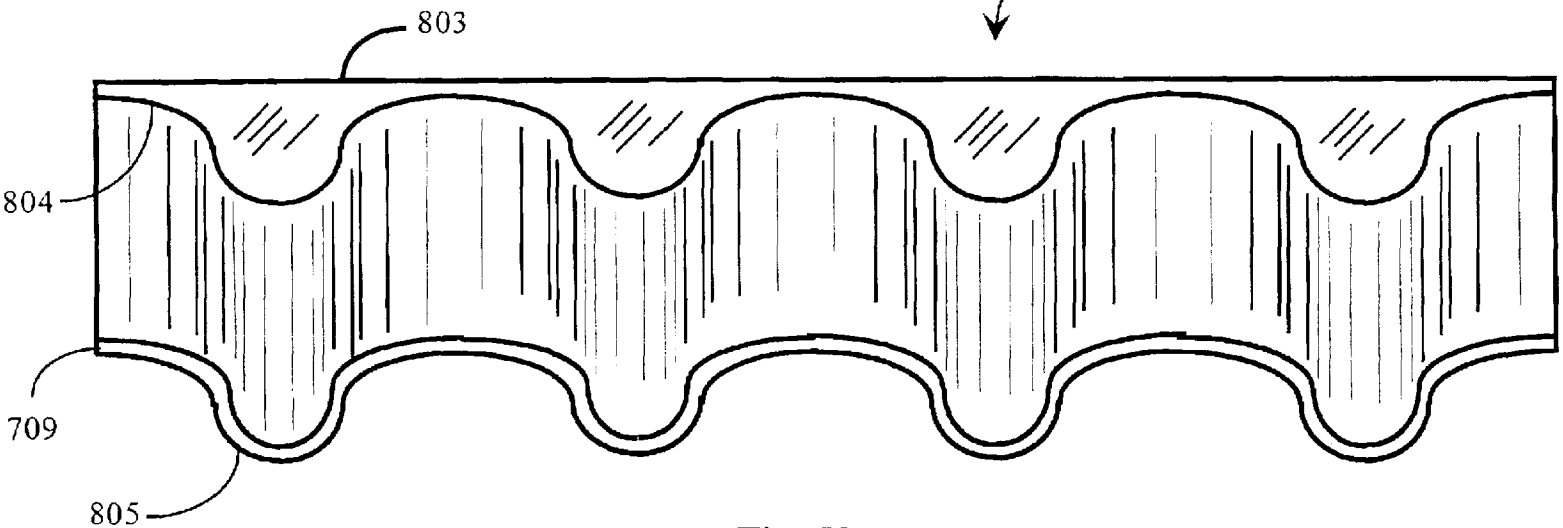

FIG. 8*b* is a plan view of an exemplary ridge seal according to the profile of FIG. 7.

Figure 9:
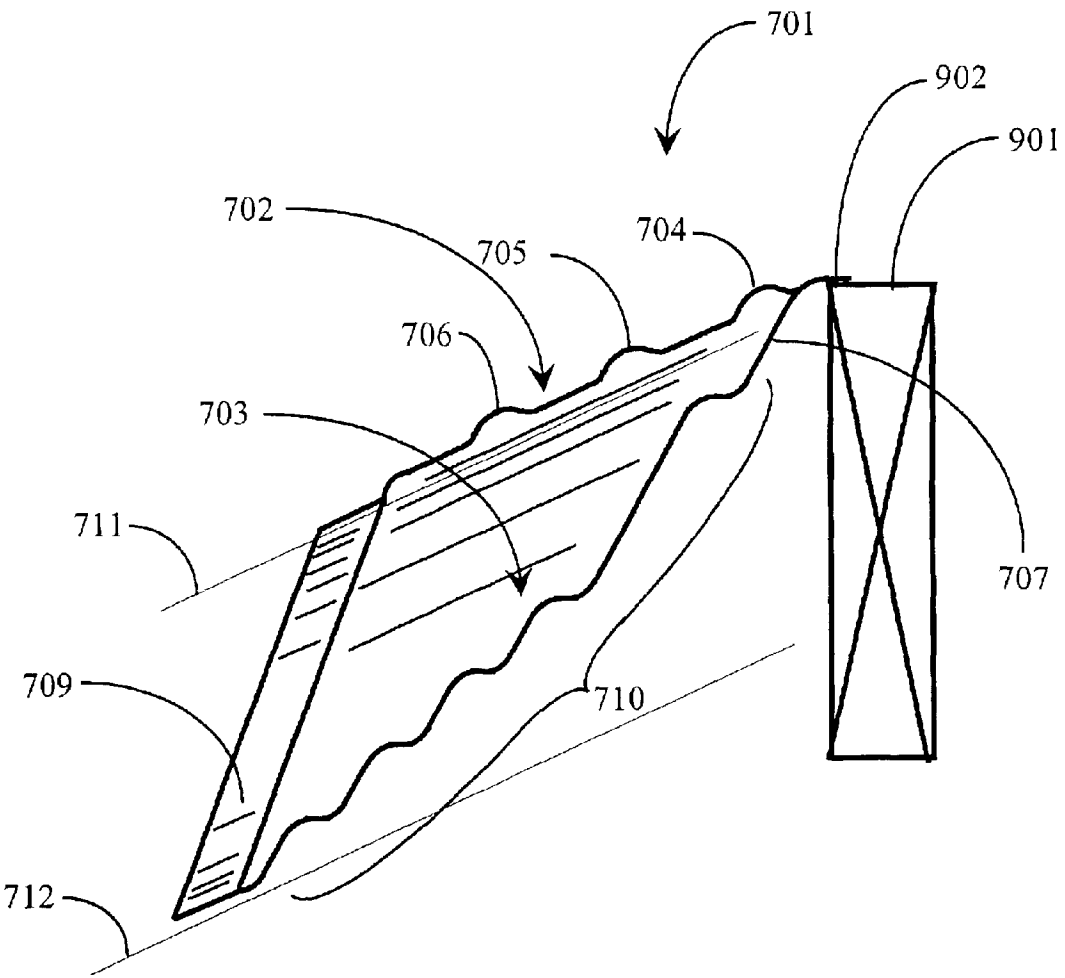

FIG. 9 is a section view of the ridge seal of FIG. 7 taken along the section line 9—9.

DESCRIPTION OF THE PREFERRED EMBODIMENTS

Figure 1:
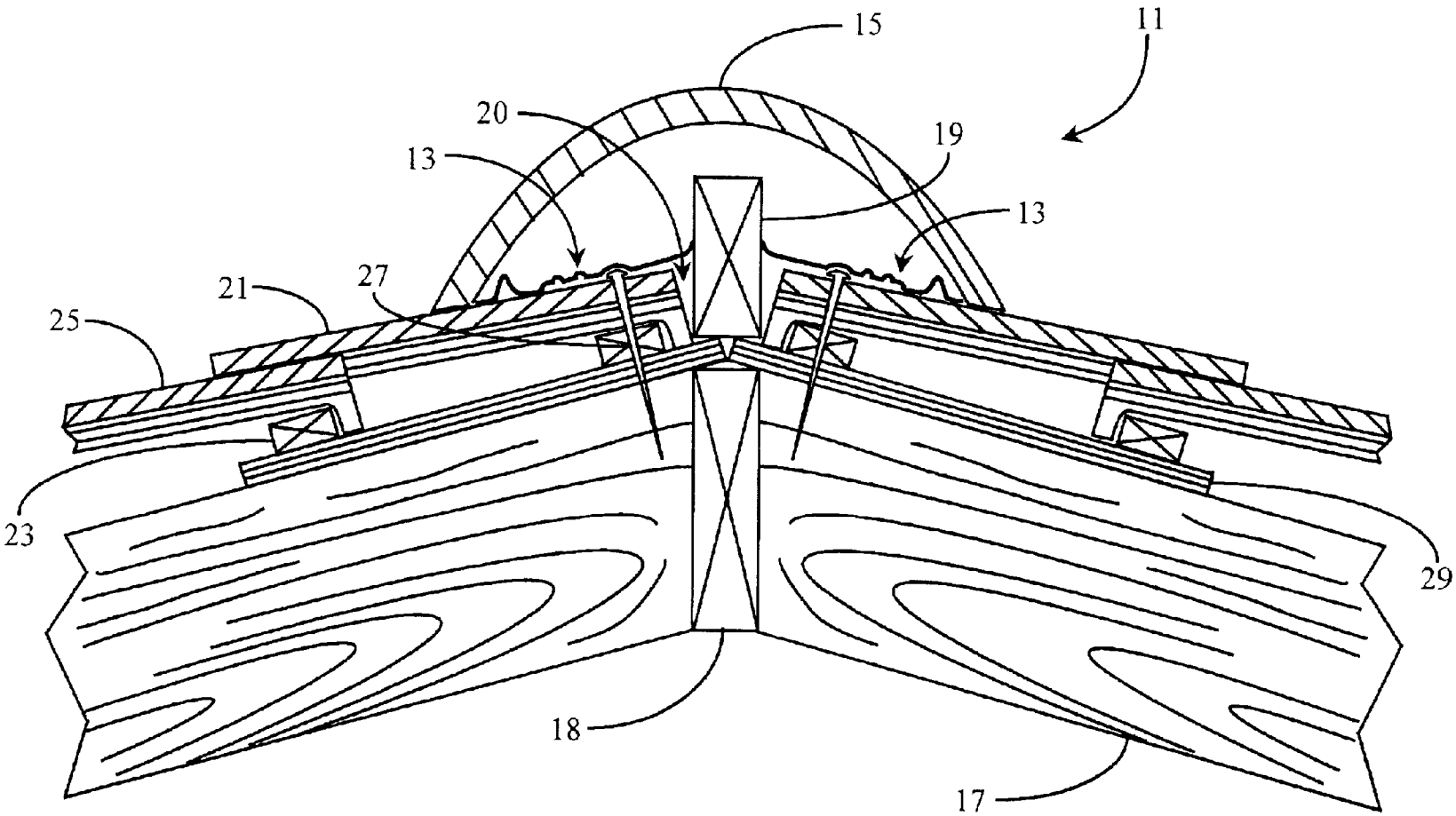
FIG. 1 is a cross-sectional view of a ridge region of a tiled roof illustrating installed ridge-seals according to an embodiment of the present invention.

FIG. 1 is a cross-sectional view of a ridge area 11 of a tiled roof illustrating installed ridge-seals 13 according to an embodiment of the present invention. Roof area 11 is typical of a tiled-roof ridge. Wooden roof beams 17 are joined at the ridge at an angle by way of ridge beam 18. This forms an underlying roof-structure having a particular pitch that may vary considerably from roof to roof.

Wooden panels 29, typically plywood, are laid over beams 17 and nailed in place to form a support surface for accepting a tile roof. Wooden cross-members 23, sometimes termed bats, are then strategically located and nailed to panels 29 to form a series of retainers over which tiles may be laid to form the tile roof. In some cases the plywood panels are not installed and the bats are nailed directly to the roof beams. Tiles 25 are hung adjacent to one another beginning at the lower edges of each roof area and overlapped in a series of rows with cross-members 23 supporting and guiding the locations of each ascending row of tiles until the ridge is reached.

Uppermost tiles 21 are identical to tiles 25 with the exception that they occupy the top row of tiles adjacent to and on either side of a ridge-beam 19. After placing tiles over cross-members 23, they are nailed in position to cross-members 23 with roofing nails 27. Cap tiles 15 are then placed over ridge-beam 19 to complete the installation. The above-described assembly and components represent an example of a typical tile-roof installation to which the method and apparatus of the present invention may be practiced.

As shown in FIG. 1, ridge-seals 13 according to an embodiment of the present invention are nailed to ridge beam 19, and, because of their shape and structure, provide an effective seal both along the ridge beam and along the adjacent tiles all along the ridge, effectively sealing the vulnerable ridge region from weather effects.

Figure 2:
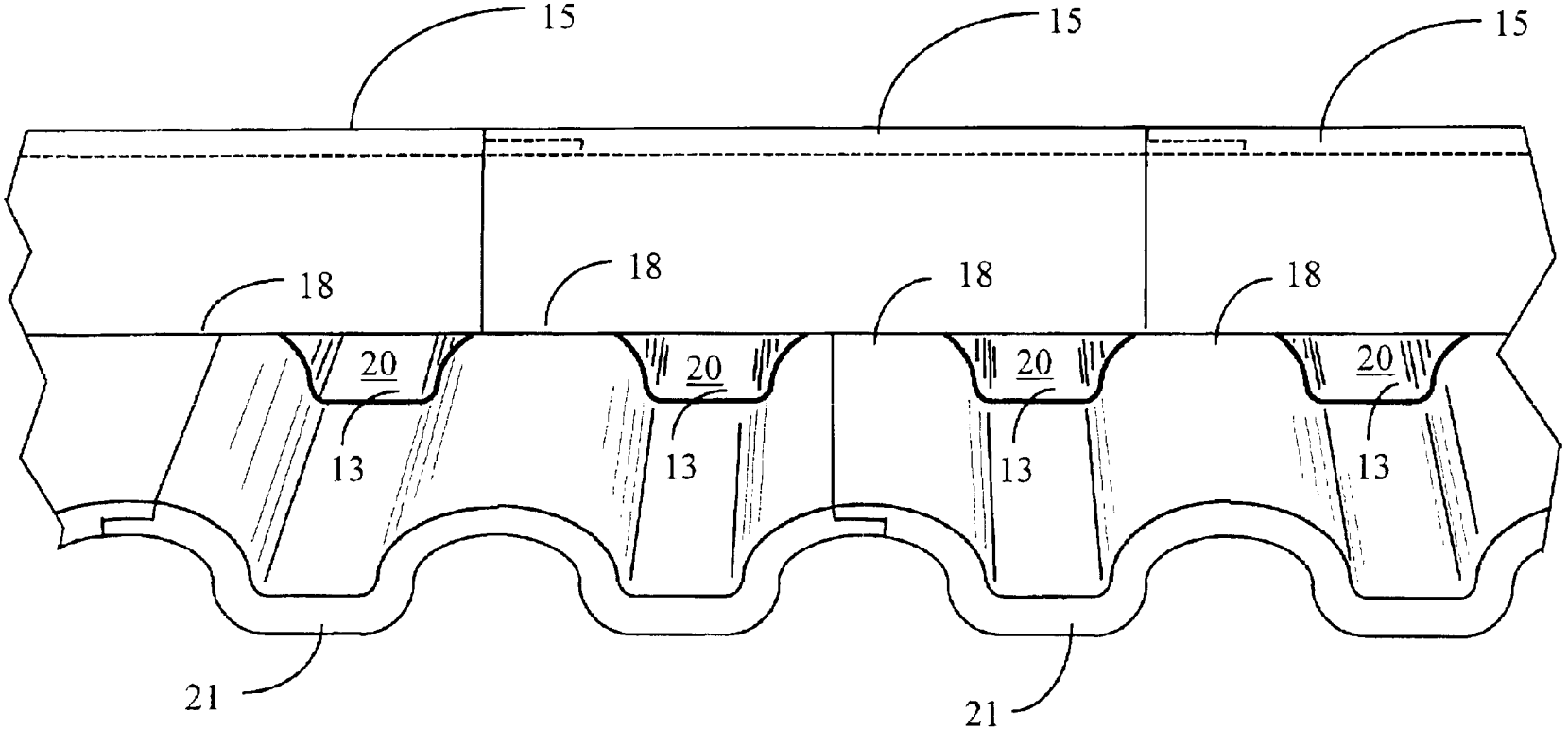
FIG. 2 is a perspective view of a ridge-seal according to an embodiment of the present invention.

FIG. 2 is a somewhat simplified perspective view of overlapping tiles 21 along a roof ridge with a cap tiles 15 in place, viewing in a direction about 90 degrees from the view of FIG. 1. The overlapping tiles 21 have, as is well-known in the art, peaks and valleys as shown, and because the cap tiles rest on the peaks of tiles 21, at points 18, there are open regions 20 beneath cap tiles 15 into volume 22 (see FIG. 1). In the view of FIG. 2A a portion of ridge seals 13 may be seen through the openings 20. In this view some small details of ridge seal 13 are omitted to avoid confusion in the drawing, but these details are described below.

FIG. 3 is a perspective view of ridge-seal 13 of FIG. 1 according to an embodiment of the present invention, disclosing more detail. Ridge-seal 13 in this embodiment is a molded polymer sheet with a back region 31 adapted to interface with a ridge nailer as shown in FIG. 1 in cross-section, and a front region 47 adapted to interface with the shape over adjacent, overlapped tiles, as best seen in FIG. 2A. In simple embodiments as known in the prior art, all of the surfaces are smooth rather than having reinforcements and other features as shown in FIG. 3, and the angle between ridge-nailer region 31 and tile-interface region is provided typically very near the pitch angle of a tiled roof to be sealed with ridge seals. That is, a relatively large number of different models of ridge seals are typically provided in the art to accommodate relatively narrow deviations in pitch.

In a preferred embodiment ridge-seal 13 is molded to the necessary shape and dimensions from a UV-resistant all-weather polymer material. Such materials are known in the art, but have not been used for ridge seals. The inventor's belief is that those with skill in the art have heretofore believed that the position of ridge seals under the cap tiles, protected from direct sunlight, has made it unnecessary for UV-resistant materials to be used. The inventor has discovered, however, that indirect sunlight can also have a deteriorating effect, and that UV-resistant materials are needed in some circumstances.

Ridge-seal 13 may be manufactured to any suitable length for modular installation, and may be of different thickness for different applications. A typical thickness is on the order of 1/16 inch. Convenient cut-lines or marks may be provided at symmetrical locations on ridge-seal 13 for cutting of different lengths for field use.

Flange 31 is angled away from main corrugate body 41 at an approximate 30 degrees from vertical. When flange 31 is nailed to the vertical surface of a ridge beam such as beam 19 of FIG. 1, corrugate body 41 of ridge-seal 13 is urged downward by resulting pressure against the uppermost row of tiles such as tiles 21 (FIG. 1). More detail about a method for applying downward pressure to corrugate body 41 will be provided below.

Drawing attention now to FIG. 1 again, it may be seen that in nailing portion 31 by nail 12 to ridge beam 19 portion 31 is not typically nailed flush to the surface of the ridge beam. The angle between portion 31 and 47 is always selected to be greater than the angle between the vertical edge of the ridge nailer and the slope of the roof. The result is that nailing portion 31 to the ridge nailer puts downward pressure along the front edge of portion 47 of the ridge seal, urging that front edge firmly against the tiles along the length of the ridge seal. This pressure is essential to a good seal to the tiles, to prevent wind, for example, from raising the front edge of the ridge seal.

Referring again back to FIG. 3, in the embodiment shown a plurality of raised ribs 33 are provided and arranged in rows along portion 31 in the direction orthogonal to the length of the ridge seal and extend laterally into portion 47 of the ridge seal. The purpose of these molded ribs is to locally reduce the flexibility of ridge-seal 13 in region 31 and at least a portion of region 47, including the interface line between portion 31 and 47. This feature increases strength and enables more downward pressure to be exerted on tiles when ridge-seal 13 is nailed into position than if the ribs were not there. In this example ribs 33 are strategically located in regions of flange 31 that are more likely to be flexible. In some embodiments raised ribs may also be added to the minor-width areas of flange 31 and may extend into the top surface of portion 47 such that the entire flange 31 and the adjacent portion of corrugate body 41 is provided with reinforcing ribs.

In this embodiment reinforcing ribs 33 do not extend to the upper edge of back portion 31, because it is intended that this upper edge provides a straight sealing surface against the top edge of the ridge nailer. The same angle limitation described above that ensures pressure along the bottom edge of portion 47 against adjacent tiles ensures pressure along the upper edge of portion 31 against the ridge nailer.

In some embodiments more or fewer reinforcing ribs are used than shown in the drawing.

Portion 47 similarly has a plurality of raised ribs 35 in the direction of the length of ridge seal. Each rib 35 is of a suitable length to cover the width of raised areas of portion 47, but does not extend into adjacent lower area. Ribs 35 act to reduce flexibility and add strength locally across the raised areas of portion 47. Another raised rib 37 is provided as a contiguous rib extending over the entire length of ridge seal 13 in the direction of the length. The purpose of rib 37 is also to reduce flexibility thereby adding strength. The area of displacement provided between ribs 37 and 35 may be such as desired by the manufacturer for obtaining more or less flexibility. For example, more ribs placed closer together reduce local flexibility by a larger degree. The same is true for ribs 33. Similarly, there may be more or fewer ribs such as ribs 33, 35, and 37 formed in ridge-seal 13 without departing from the spirit and scope of the present invention.

A contiguous shoulder-rib 39 is formed alongside of and in close proximity to rib 37. Shoulder rib 39 characterizes a downward formation (shoulder) of which the under-side edge thereof provides an intimate contact line with the corrugated surface of the uppermost row of tiles (tiles 21 of FIG. 1) when ridge-seal 13 is nailed into position. This first contact line extends (laterally) over the sum of widths of all covered tiles placed in a row such that a lateral seal may be created that conforms with the corrugated profile presented by the row of tiles. In one embodiment, a cord of sealing material, such as caulking material may be laid along the underside recess formed by rib 39 such that an effective seal is against the adjacent covered tiles.

In this embodiment yet another rib 43 is provided and extends contiguously along the front edge of portion 47 and is substantially parallel to shoulder rib 39. Rib 43 is formed at the same level presented by shoulder rib 39 such that it provides a second line of contiguous contact with uppermost tiles in the same fashion previously described. A sealing material may also be laid along the under-recess formed by rib 43 thereby providing a second contiguous seal that provides an effective barrier to weather effects. If a sealant is used to seal at both rib 39 and at rib 43, a double seal effect is created. It should be noted that the use of sealing material is not required in the practice of the present invention in order to form an effective seal. The lower contacting surfaces of shoulder 39 and the area of rib 43 form a contiguous seal under pressure. The provision of recesses adapted to accept mastic material is a convenience that may provide extra protection in areas where high winds are more frequent and prevalent than other areas. A peripheral lip 49 extends from the edge of seal rib 43 and forms the edge of front portion 47. Lip 49 also makes contact with underlain tiles. A plurality of raised annuluses 51 are provided at nail locations of underlying tiles to accommodate raised nail heads.

Figure 4:
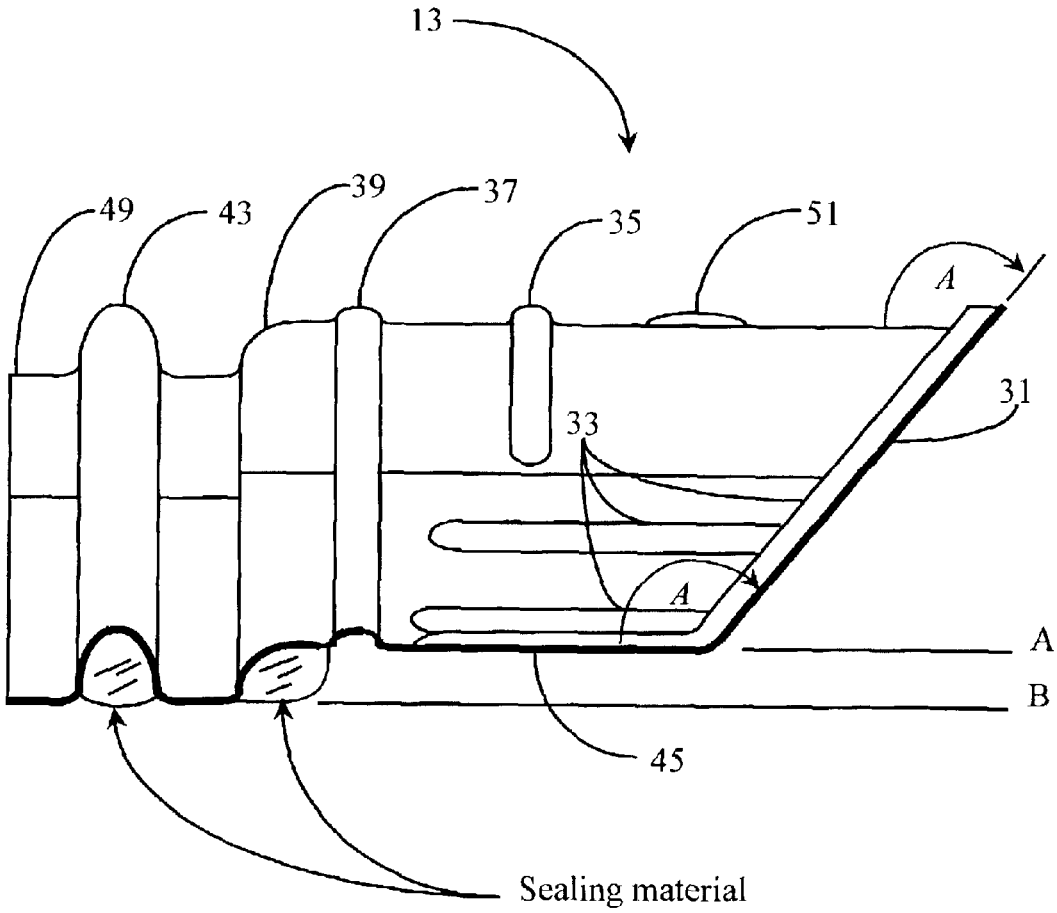
FIG. 4 is a a section view of the ridge seal of FIG. 3 taken along the section line 4—4 in FIG. 3.

FIG. 4 is a section view of ridge-seal 13 of FIG. 3 taken along section line 4—4 of FIG. 3. In this section view the heavier line represents the cut section through the relatively thin material used to make the molding. This view also presents a dual-planer nature exhibited by the surface profile of portion 47 exemplifying a lower surface-plane A and a lower surface-plane B as represented by lines A and B. The lower surfaces of Lip 49, rib 43, and the lower edge of shoulder seal 39 are at surface plane B while the lower surface of the remaining portion of ridge-seal 13 toward back portion 31 lies at lower surface-plane A. This configuration produces an intimate contact surface, which is surface plane B, between underlying tiles (not shown) and ridge-seal 13 as previously described. Recesses presented by rib 43 and shoulder rib 39 may be filled with a sealant as previously described and as illustrated. In some environments where wind driven rain is not a major factor or particularly troublesome, mastic sealing may be applied to only one of ribs 43 or 39, or perhaps, not at all. In these areas the sealant-receiving ribs may not be molded in the ridge seals.

As previously described, ribs 33, 35, and 37 are provided to reduce flexibility thereby adding strength. Angle A 31 is approximately 120 degrees in this embodiment, but may be at other angles as appropriate for different applications. This angle is always significantly greater than the obtuse angle of the roof with vertical, so the lower edge of the ridge seal will be firmly urges against the roof tiles across the width of the ridge seal.

In a preferred embodiment two models of ridge seals are provided to be effectively applicable to roofs of pitch all the way from very shallow to very steep, say from about ten degrees to as much as 45 degrees. Steeper pitch is considered dangerous, as loose tiles can slide off roofs of very steep pitch.

A first model for two model coverage has an angle A of about 120 degrees, and is for use on roofs from a pitch of about ten degrees to about 22.5 degrees. A second model has an angle A of about 150 degrees, and is intended for roofs with a pitch of from 30 degrees up to 45 degrees.

Figure 5:
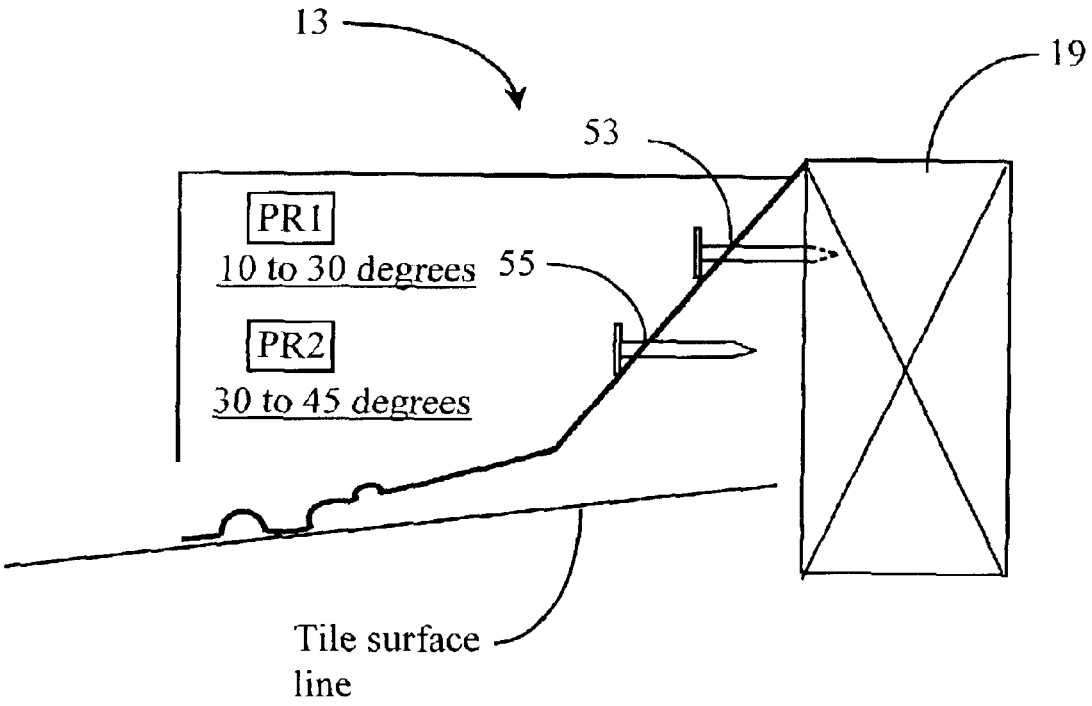
FIG. 5 is a largely diagrammatic elevation view illustrating a process of nailing a ridge seal according to an embodiment of the invention to a ridge beam.

FIG. 5 is a diagram illustrating alternative nail positions for ridge seals according to embodiments of the present invention. A user installing ridge-seal 13 to a ridge-beam 19 must take into account the pitch of the roof. Although in the art pitch is defined as the linear vertical change over linear horizontal change along a roof line, such as 4:12, which means 4 inches vertically for 12 inches horizontally, pitch is referred to herein as an angle with horizontal; a 10 degree pitch then is very shallow, and a 45 degree pitch is very steep.

A system utilizing two models for covering a broad range of pitch, over the range likely to be encountered, was described just above. In this system, as pitch changes within each range, the relative initial angle of back portion 31 of a ridge seal according to an embodiment of the invention with the vertical surface of the ridge nailer will vary.

Consider the first of two seals with a molded angle A of 120 degrees applied to a roof with a ten degree pitch. The initial angle of portion 31 with the vertical surface of the ridge nailer beam will be 50 degrees. With such a large angle, one would preferably position a nail relatively high on portion 31, for example, at position 53*a*. Applied to roofs of greater pitch, the initial angle is less. For example, the same ridge seal applied to a roof of 20 degrees pitch will have an initial 40 degree angle. To a roof of pitch 30 degrees, the angle will be 30 degrees.

It is desirable that the initial angle be relatively large, so in the nailing, significant pressure may be applied to the seal line at the bottom edge of portion 47 over the tiles. In this scheme the initial angle is always at least 30 degrees. Still, as the initial nailing angle becomes smaller, one will have to drive a nail further into the nailer beam to accomplish adequate pressure along the lower sealing line. Driving the nail further is not always a good option, however, as it entails extra effort and time. Because of this, in the two models provided to cover the expected pitch range, at least two nails positions are marked in back portion 31, these being 53 and 55 as shown in FIG. 5.

For the first ridge seal, identified as PR 1, for pitch range 1, having an angle A of 120 degrees, one would use nail position 53 for pitch from about 10 to about 20 degrees, and nail position 55 from about 20 degrees to about 30 degrees. For the other ridge seal, identified as PR2, one would use the first nail position 53 for pitch of from 30 to about 38 degrees, and the second nail position 55 for pitch from about 38 to about 45 degrees. These nail positions are also shown marked in FIG. 2. In some embodiments the positions are predrilled, and may also have reinforced shoulders.

Figure 6:
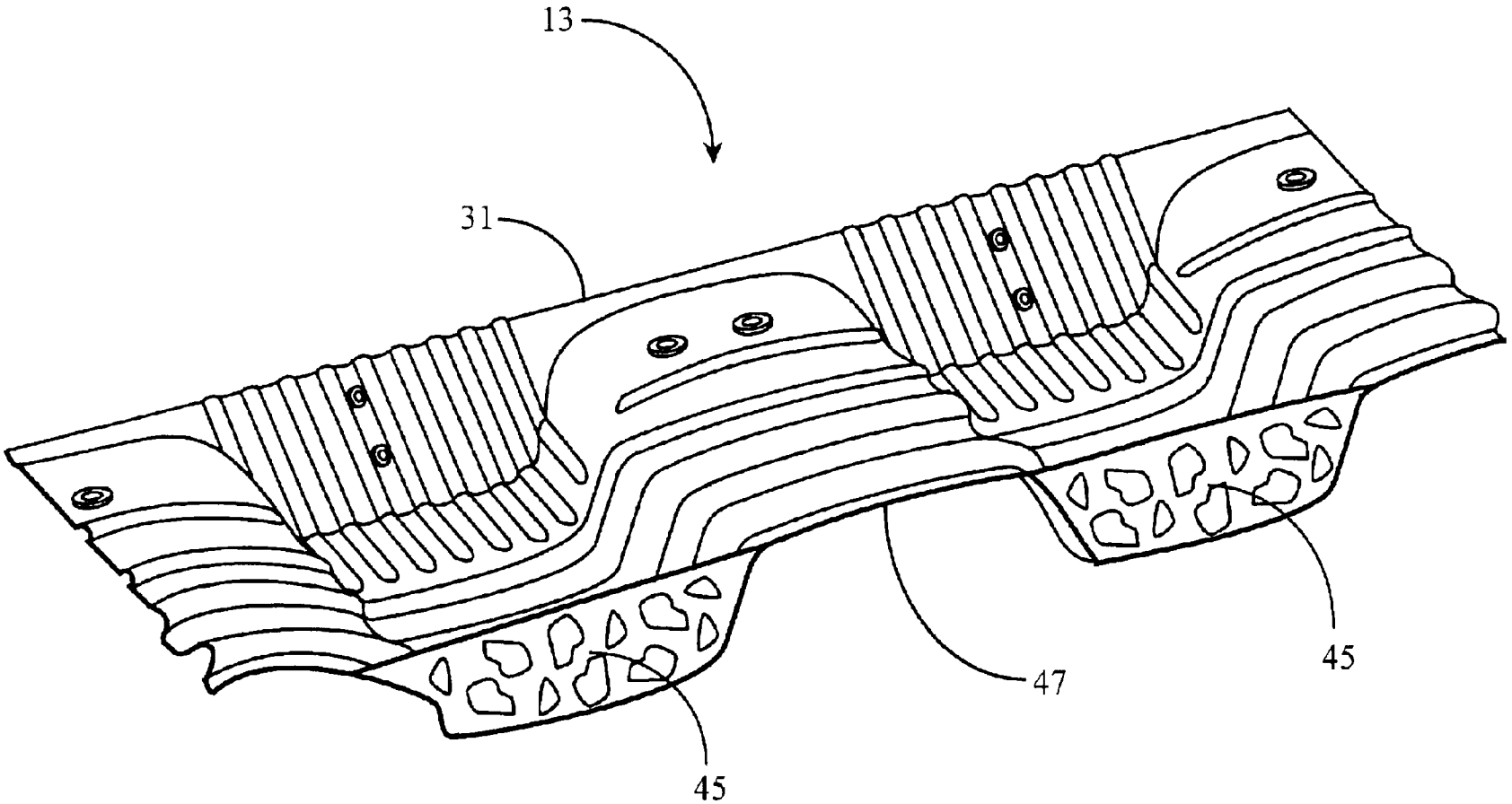
FIG. 6 is a perspective view of a ridge seal similar to that of FIG. 3, adding a panel according to an embodiment of the invention.

In another embodiment of the present invention, to simulate the mudded-in look that is popular with some homeowners, without the necessity of using concrete, with the mess and danger that this procedure brings, special panel 45 are molded into the ridge seal as shown in FIG. 6. These panels are textured and colored to simulate concrete, so that, when installed, the panels 45 are seen at the openings 20 of FIG. 2. It will be apparent to the skilled artisan that the panels can take any of several forms, and may be textured and colored in any of several ways.

Enhanced Pan Portion for Ridge Seal Molding

Referring again to FIG. 3, front portion 47 was described above as an undulating portion of alternating regions to fit the undulating shape of tile roofs. In words of the art for such tiles, the raised part of the tile line is called the cap portion, and the lower part is called the pan portion. For purposes of this specification, therefore, in a ridge seal the part that contacts the cap portion of the tiles will be referred to as the cap portion of the ridge seal, and the portion that contacts the pan portion of the tiles will be referred to as the pan portion of the ridge seal.

It will be clear to those with skill in the art that in service, rainwater falling on such a roof will migrate quickly to the lower pan portions, which form alternating gutters down the slope of the roof, and will highly preferably run down these portions to the lower edges of a roof. It is also true that in service it has been found that the most vulnerable part of a ridge seal to tile engagement to wind-driven rain is that area where the pan portions of the seal contacts the pan portions of the tiles. What is clearly needed therefore is an enhanced ridge seal that provides enhanced sealing characteristics in this pan-to-pan region.

FIG. 7 is a perspective view of a ridge seal 701 in an alternative preferred embodiment of the present invention. Ridge seal 701 is shown foreshortened lengthwise in FIG. 7 for the sake of simplicity, ending in the middle of two adjacent cap portions 702, and showing just one pan portion 703. There will, in most embodiments however, be several pan portions and several cap portions, and the ends will be in the middle of cap portions as shown. The ends are at cap portions for the reason given above, that practically all water runs down in the pan portions of a tile roof.

Ridge seal 701 has reinforcing ridges 704, 705 and 706 molded into the cap portions, and there may be fewer or a greater number of such ridges in other embodiments. In ridge seal 701 vertical nailing panel 707 is relatively small, and the pan portion of the seal is implemented in stepwise fashion from the nailing panel to the front of the pan portion at sealing strip 709, which runs the full length of the ridge seal, and contacts tile over both the pan and cap portions.

Ridge seal 701 is unique in another aspect as well. FIG. 8*a* is a plan view mostly in outline of ridge seal 13 of FIGS. 1-6. The direction of view is at 90 degrees to the pitch line. In this view it can be seen that edge 802 along sealing lip 49 is straight and parallel to edge 801 along the nailing panel.

Referring now to FIG. 8*b*, viewing ridge seal 701 of FIG. 7 from the same vantage point as for ridge seal 13 of FIG. 8*a*, the pan portions are substantially increased in length compared to the cap portions. In this particular embodiment the shape of the edge along lip 709 is substantially the same as the shape of the intersection between the nailing panel and the cap and pan portions. This is not a limitation, but a particular example. In other embodiments the shape may vary, but an important object is that the pan portions, in an installed ridge seal, extend further down the roof line than the cap portions.

It was described above that rain water runs off of the cap portions of tiles everywhere on a tile roof, and runs into the pan portions and down the roof. There will therefore necessarily be more water in the pan portions, even at the top of the roof where ridge seals are installed along a ridge beam under the topmost tiles. This is the area as well that is most vulnerable to wind, therefore to wind-blown water. Having the pan portions of the ridge seal extend further down the roof line, in conjunction with the novel shape of the pan portions as seen in FIG. 7, and described further below with reference to FIG. 9, provides a substantially improved weather seal.

FIG. 9 is a section view of ridge seal 701 of FIG. 7 taken along the section line 9—9. Ridge seal 701 is shown in this view juxtaposed to a ridge beam 901 and a tile roof, the roof represented by two lines 711 and 712, the former representing the cap line and the latter the pan line for roof tiles. Ridge seal 701 has a small lip 902 to fit over the top of beam 901, and is typically nailed to the beam through the nailing flange 707. Nails are not shown. From the profile shown, however, it will be apparent that nailing through flange 707 into beam 901 will cause ridge seal 701 to be urged along sealing lip 709 into the roof tiles in an undulating line over the several cap and pan portions covered. Pressure attained to seal will depend to some extent on the extent to which nails are driven into beam 901.

FIG. 9 clearly illustrates that, because of the unique shape of the lower edge of the ridge seal, lip 709 extends further down the roof line in the pan portions than in the cap portions. In addition, the pan portion 703, by the angle and shape of stepped region 710, stands away from the pan portion except for lip 709, and the stepped design provides a spring effect for transferring force to lip 709 from nailing flange 707.

It will be apparent also to one with skill in the art that there are many alterations that may be made in embodiments of the present invention described above without departing from the spirit and scope of the invention. For example, one style of ridge seal may be used modularly on different pitch roofs by way of conventions already described. Moreover, such a ridge-seal may be formed to work with a wide variety of different tile sizes and shapes. Variant colors and patterns simulating clay, concrete, etc. may be provided for different tile styles. Specific structural details of seal 701 of FIGS. 7-9 may vary widely while accomplishing the unique functions for which the seal is intended. The spirit and scope of the present invention therefore is limited only by the claims that follow.

What is claimed is:

1. A ridge seal molding having a length and width, comprising:

a nailing flange with one straight edge to engage a ridge beam, the nailing flange for nailing the molding to the ridge beam, providing thereby a continuous contact along at least the one straight edge the length of the molding to the ridge beam; and a cover section formed generally at an angle to and contiguous with the nailing flange and having an undulating shape of adjacent cap and pan portions in the direction of the length to match the undulating shape of adjacent tiles along a front edge, the cover section having a sealing edge of an undulating shape opposite the one straight edge of the nailing flange;

characterized in that a first dimension from a point on the one straight edge of the nailing flange to the sealing edge taken along an axis of a pan portion is substantially greater than a second dimension from a point on the one straight edge of the nailing flange to the sealing edge taken along an axis of a sealing portion, the pan portions of an installed ridge seal therefore extending further down a roof than the cap portions.

2. The ridge seal molding of claim 1 further comprising an offset lip along the sealing edge for contacting tiles in both the pan and the cap portions.

3. The ridge seal molding of claim 2 wherein the offset lip is arched to retain a sealant.

4. The ridge seal molding of claim 1 wherein the cover section along an axis of a pan portion comprises a stepped panel beginning at a juncture with the nailing flange and extending to the sealing edge, the stepped panel in an installed seal being therefore substantially above the tile at the juncture with the nailing flange and in contact with the tile at the sealing edge.

5. The ridge seal molding of claim 1 further comprising one or more reinforcing grooves in the direction of the length, and extending over only the cap portions of the molding.

6. The ridge seal molding of claim 1 further comprising a ridge lip along the one straight edge of the nailing flange, at an angle to the nailing flange, for engaging a top surface of the ridge beam.

7. The ridge seal molding of claim 1 wherein material for the ridge seal molding is a material formulated for resistance to ultraviolet deterioration.

* * * * *